US006758058B1

(12) United States Patent
Citrynell et al.

(10) Patent No.: US 6,758,058 B1
(45) Date of Patent: Jul. 6, 2004

(54) REMOVABLE COOLING DEVICE AND INTEGRATED VESSELS

(75) Inventors: Andrew Citrynell, 264 Sunrise La., Carbondale, CO (US) 81623; Kimberly Ann Miller, Carbondale, CO (US)

(73) Assignee: Andrew Citrynell, Carbondale, CO (US)

( * ) Notice: Subject to any disclaimer, the term of this patent is extended or adjusted under 35 U.S.C. 154(b) by 0 days.

(21) Appl. No.: 10/389,733

(22) Filed: Mar. 14, 2003

(51) Int. Cl.[7] ..... F25D 3/08
(52) U.S. Cl. ..... 62/457.4; 62/457.3; 62/530
(58) Field of Search ..... 62/457.3, 530, 62/457.1, 457.4, 371, 438, 529; 220/709, 739

(56) References Cited

U.S. PATENT DOCUMENTS 4,765,393 A 8/1988 Baxter
5,044,173 A 9/1991 Cheng
5,189,892 A 3/1993 Roberts
5,467,877 A 11/1995 Smith
5,597,087 A 1/1997 Vinarsky
6,474,096 B1 11/2002 de la Guardia

*Primary Examiner*—Chen-Wen Jiang
(74) *Attorney, Agent, or Firm*—Townsend and Townsend and Crew LLP

(57) ABSTRACT

In one embodiment, a beverage container comprises a vessel having an interior that is adapted to hold a beverage. The vessel has a closed bottom end and an open top end. The bottom defines a cavity that is fluidly filled from the interior of the vessel. A cooling element is configured to fit within the cavity. A base comprises a bottom member and a stem extending vertically upward from the bottom member. The base includes a connector that is configured to be coupled to the bottom end of the vessel and to enclose the cooling element within the cavity.

5 Claims, 6 Drawing Sheets

REMOVABLE COOLING DEVICE AND INTEGRATED VESSELS

BACKGROUND OF THE INVENTION

This invention relates generally to the filed of cooling beverages, and in particular to the use of removable cooling elements that may be integrated into various beverage containers. Such cooling elements are removable to permit them to be placed into a refrigerator freezer and reused.

Perhaps the most common method to cool beverages is with ice cubes. Another way to frost a glass in a freezer. However, there are many problems associated with these methods. For example, ice cubes dilute the beverage and can alter the taste of the beverage. Ice cubes may also be contaminated when touched, such as when placing them into the beverage. As another example, when frosting a glass in the freezer, the frost can be contaminated by other products in the freezer, causing an odor. As a further example, the beverage may be contaminated by the water used to make the ice.

Hence, this invention is related to devices and techniques for cooling beverages which greatly reduces or eliminates such drawbacks.

BRIEF SUMMARY OF THE INVENTION

In one embedment, the invention provides a beverage container that comprises a vessel having an interior that is adapted to hold a beverage. The vessel has a closed bottom end and an open top end, with the bottom end defining a cavity that is fluidly sealed from the interior of the vessel. The beverage container also includes a cooling element that is configured to fit within the cavity. The beverage container further includes a base comprising a bottom member and a stem extending vertically upward from the bottom member. The base includes a connector that is configured to be coupled to the bottom end of the vessel and to enclose the cooling element within the cavity. In this way, a beverage held within the vessel may be cooled by the cooling element that is fluidly sealed from the interior of the vessel. As such, the beverage may be cooled without contamination from the cooling element. Further, the cooling element may easily be removed and replaced with a fresh cooling element whenever needed.

In one aspect, the connector comprises a threaded end on the stem. The cavity may also include a threaded section so that the threaded end may be screwed up into the cavity using the threaded section. In this way, the exterior of the beverage container may contain a smooth morphology to make the container more aesthetically pleasing. At the same time the beverage container may easily be separated into its component parts for cleaning, replacement of the cooling element, or the like.

In another aspect, the cavity may be generally cylindrical in geometry and extend vertically upward into the interior of the vessel. With such a configuration, the cooling element may comprise a cylinder that is filled with a cooling substance. In a further aspect, both the connector and the vessel may be constructed of various materials, such as glass, hard plastics, glass coated with a hard plastic, and the like.

The beverage containers of the invention may be configured into a wide variety of shapes while still providing a suitable cooling element. For example, the vessel may be in the shape of a mug, a wine glass, a martini glass, a tumbler, a stein glass, a margarita glass, a champagne glass, and the like.

In one particular embodiment, the bottom end of the vessel may define a generally hemispherical cavity that is fluidly sealed from the interior of the vessel. With such configuration, a generally hemispherical cooling element may be provided to fit within the cavity. In this way, the base may be coupled to the bottom end of the vessel to enclose the cooling element within the cavity. The use of a generally hemispherical cooling element is advantageous in that it maximizes the surface area available for heat transfer. Such a cooling element is also particularly useful in beverage containers that have the shape of a tumbler, mug, or the like because the generally hemispherical cavity fits nicely within the interior of the vessel. Conveniently, the vessel may include threads while the bottom end of the vessel also includes threads to permit the base to be screwed into the vessel.

Another feature of the invention is that it may include one or more trays having a plurality of holding regions for holding the cooling element. In this way, the tray may be placed into a freezer to simultaneously cool multiple elements.

In one aspect, the tray may include a plurality of recesses that are integrally formed in the tray to define the holding regions. The recesses may be in the shape of the cooling element so that they may easily fit within the recesses. For example, the recesses may be semi-cylindrical, hemispherical, and the like.

DETAILED DESCRIPTION OF THE INVENTION

Figure 1:
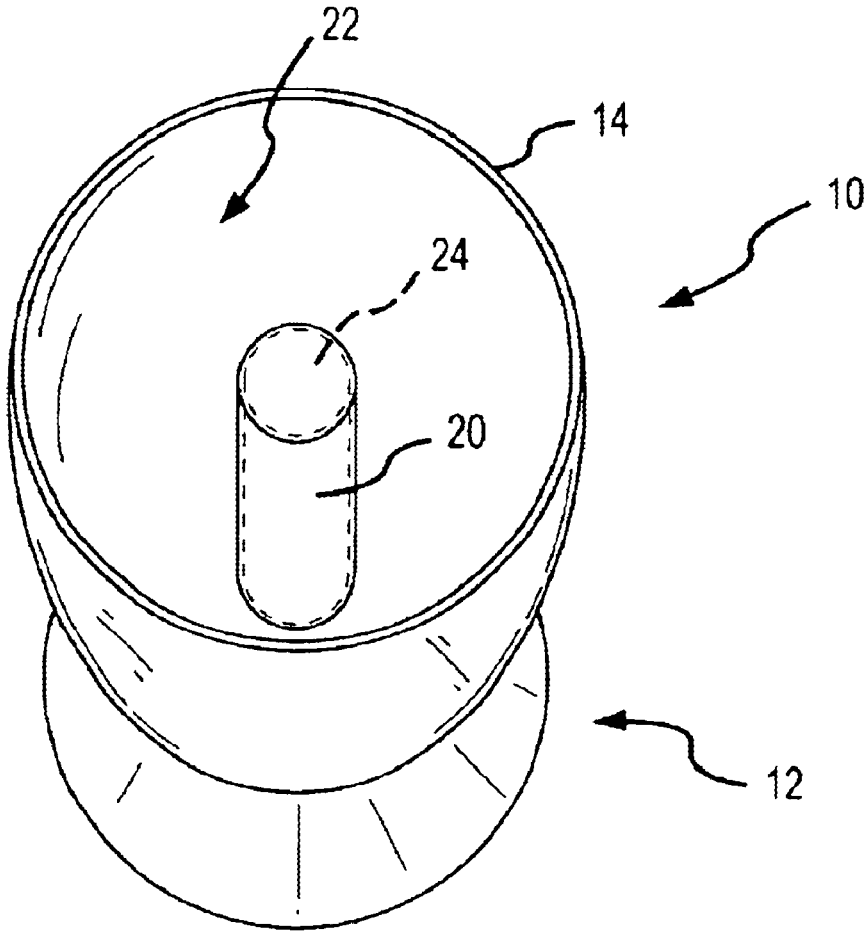
FIG. 1 is a perspective view of one embodiment of a beverage container according to the invention.
Figure 2:
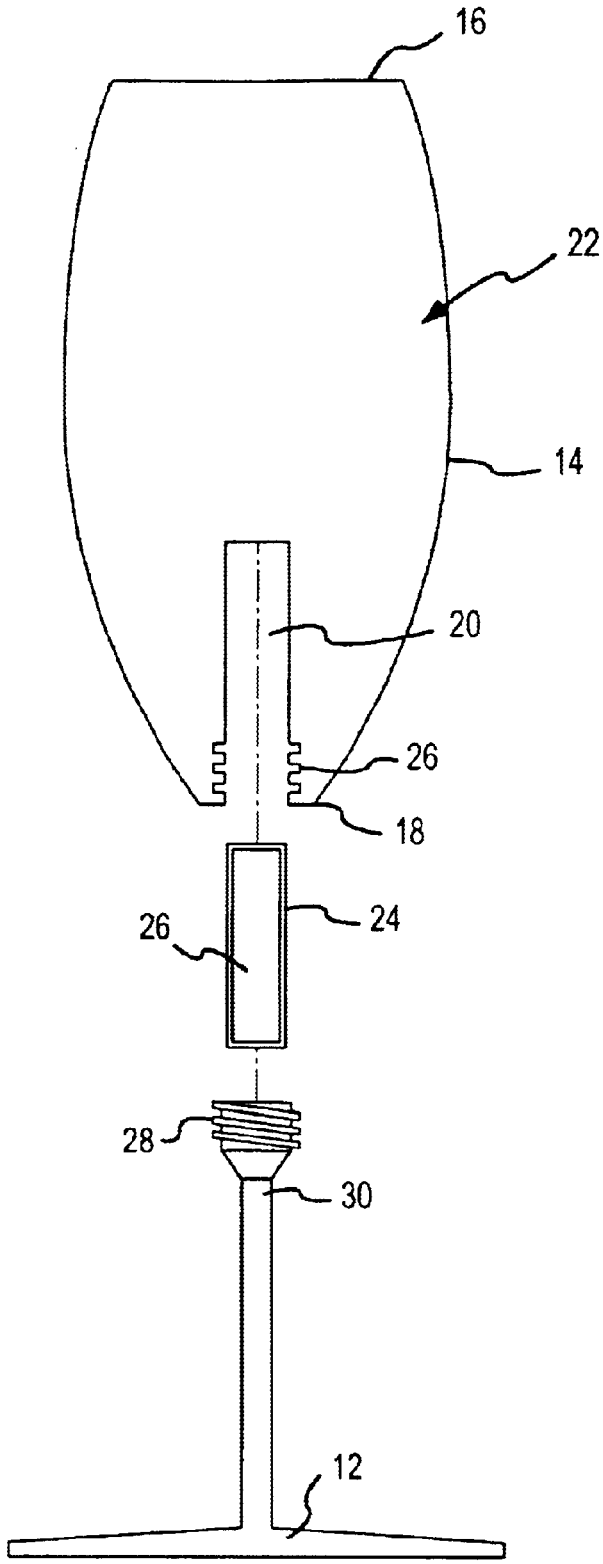
FIG. 2 is an exploded side view of the container of Fig. 1.

The invention provides various beverage containers that may be used with removable and reusable cooling elements. The containers each include a vessel for holding the liquid and a cavity for holding the cooling element. The cavity is sealed from the interior of the vessel but also extends up into the vessel to provide a cooling effect. The cavity may have a variety of shapes configured to maximize heat transfer away from the liquid. Such shapes may include cylindrical, hemispherical, pyramid shaped, arcuate, square, triangular and the like. The cavity may conveniently have a shape that is similar to the cooling element, although that is not necessary. The wall thickness may also be minimized to maximize heat transfer. The cooling element may contain any substance that can be cooled and serve to absorb heat. Examples include water, gels, Blue Ice®coolant, any non-toxic re-freezable substance, and the like. Alternatively, the cooling element may be a solid substance, such as a metal rod, a piece of ice, or the like. The cooling element may be held in the cavity by a base that has one or more connectors to connect the base to the vessel. Examples of connectors include threads, clips, snaps, screws, press fits and the like. The base may be screwed, twisted, locked or snapped into place. One advantage of using threads is that the vessel may be coupled to the base utilizing relatively few threads. In this way, the two components may be locked together using a single twist. Further, such threads permit the two components to be easily unscrewed, even when the vessel is filled with liquid so that the cooling element may easily be replaced. Few threads also reduce the changes of having the vessel or the base break. Further, with few threads, the beverage container remains symmetrical when assembled, while still being easy to fit together.

Hence, the invention provides a removable cooling element for cooling beverages that may be placed into a regular refrigerator freezer between uses. The removable device when frozen may be placed into an upper portion of the vessel, and a bottom portion may then be attached to the upper portion. The device easily fits into the vessel, which may be constructed of a wide variety of materials, such as glass, plastic or the like. The base of the beverage container may be tubular, cubical, semicircular, pyramidal, or the like, and may be connected to the bottom of the vessel by a stem or end portion that attaches to the bottom of the vessel and seals in the cooling element. When threads are used, they may be constructed of a hard plastic or glass with a hard plastic coating. As another example, one of the threaded elements may be a hard plastic while the other is made of glass, or both may be of a hard plastic. The vessels may be made of glass, plastic, a disposable plastic, or the like. As one specific example, the male threading may be on the base or stem and may be constructed from a hard plastic or glass with a hard plastic coating on a glass stem. Such materials serve to seal the cooling device into the integrated vessel and base to cool the beverage without ever contacting it. As such, the cooling device may be replaced even while the fluid is in the vessel to provide additional cooling.

The cooling element may also be made of a hard plastic, and the re-freezable substance may be of any color. Similarly, the vessel may also be of any color.

When the cooling device is removed, it may be washed and then kept in the freezer in an appropriate cooling tray. The tray may have regions that are shaped to hold the particular cooling element. Because the removable cooling element is never in contact with the interior of the vessel, it is always hygienic.

Such a system provides a variety of advantages. For example, as just described, the beverage is hygienically cooled using a reusable cooling device that never contacts the beverage. The cooling elements fit neatly into a tray and take up little room in the freezer, usually less than an ordinary ice tray.

Further, the beverage container may be separated into parts to facilitate washing. For example, the stem may be separated from the vessel and separately placed into a dishwashing machine with a reduced risk of being broken.

The beverage container may also come in an assortment of colors to make identification of the container simple, thus resulting in less chance of the spreading of germs by drinking from another's glass. Different colors may also be used for the cooling element, the fluid within the cooling element and the cavity used to hold the cooling element.

The extension into the interior of the vessel takes up extra volume. In this way, restaurants and bars may increase their profits per drink.

The beverage also does not get diluted with melting ice, and there is no contamination from the ice/odors or impurities in the water. This is also true with frosted glasses, where the frost can have odors or contamination from the water used to make frost.

Also, since no ice cubes are placed into the beverage, there is no chance of contamination from a person's hand used to place the ice into the beverage. In fact, no human contact with the beverage is ever experienced.

Referring now to FIG. 1, one embodiment of a beverage container 10 will be described. Container 10 comprises a base 12 and a vessel 14 having an open top end 16 and a closed bottom end 18. Formed in bottom end 18 is a cavity 20 that extends up into the interior 22 of vessel 14. Cavity 20 is cylindrical in geometry and is sized to receive a cylindrical cooling element 24. The bottom of cavity 20 has threads 26 for receiving a threaded end 28 of a stem 30 that is part of base 12. In this way, cooling element 24 containing a cooling substance 25 may be inserted into cavity 20, and threaded end 28 of stem 30 may be screwed into threads 26 to completely seal cooling element 24 within cavity 20. One advantage of using internal threads within cavity 20 is that a continuous smooth surface is provided at the interface between vessel 14 and stem 30. As such, container 10 has the appearance of a traditional wine glass, except for the presence of cooling element 24 that extends into interior 22. However, this has the advantage of reducing the volume of interior 22 so that restaurants and bars can reduce the amount of beverages served while still charging the same amount.

Another advantage is that the cooling element 24 is almost entirely exposed to interior 22 to maximize heat transfer. Further, since cooling element 24 is sealed from the beverage, no contamination of the beverage by a coolant occurs. Container 10 is also aesthetically pleasing and can be fashioned in essentially any shape or configuration, including conventional shapes and designs as described hereinafter.

In use, cooling element 24 is placed into a cold location, such as a refrigerator or freezer. When ready to pour a beverage, cooling element 24 is removed and placed into cavity 20. Threaded end 28 is then screwed into cavity 20 until it is unable to turn and a smooth surface at the joint is formed. A beverage is then poured into vessel 14 where it is cooled by cooling element 24. At any time, base 12 may be unscrewed and cooling element 24 replaced with another one.

Figure 3:
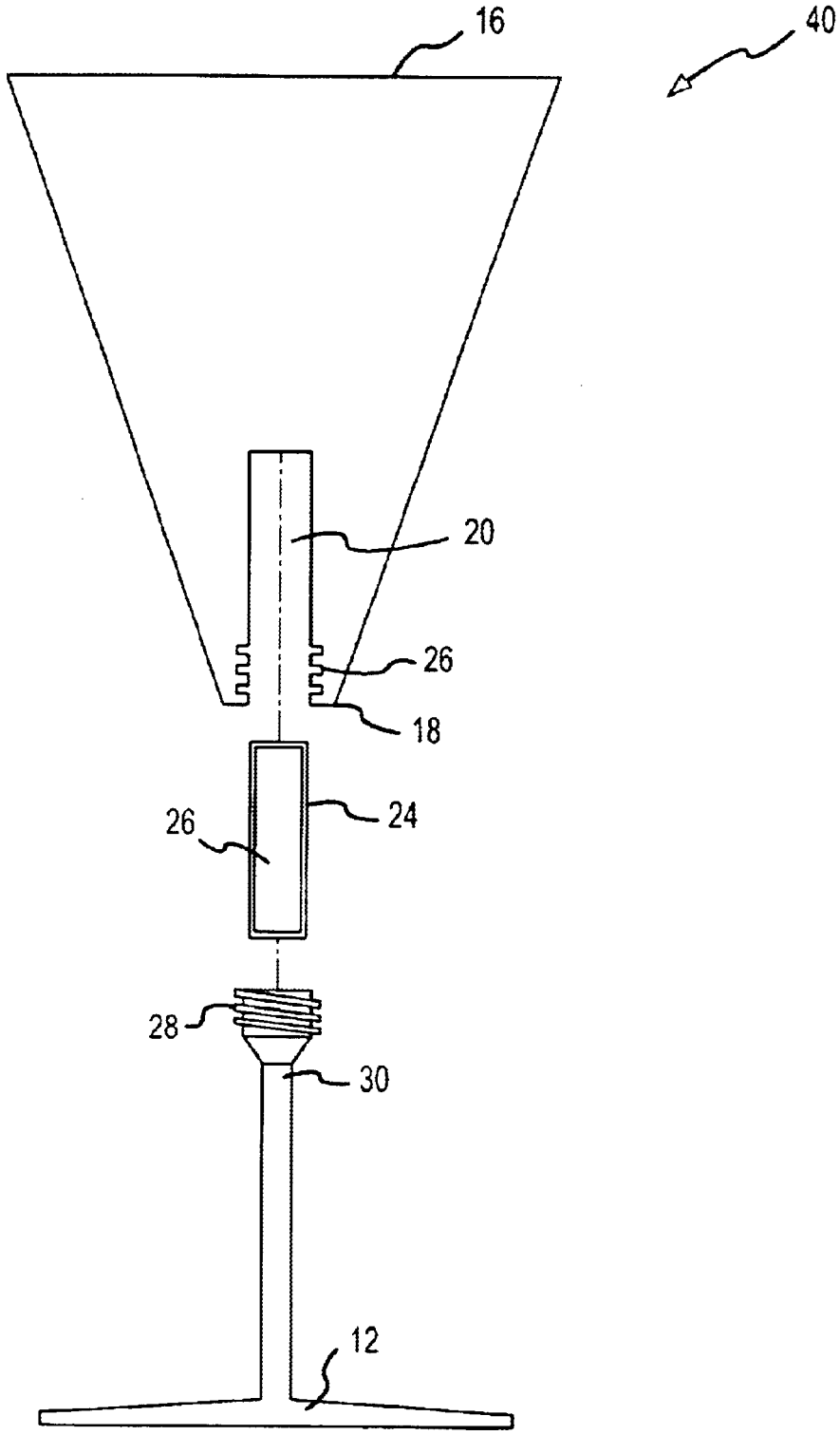
FIG. 3 is an exploded side view of another embodiment of a container according to the invention.

Referring now to FIG. 3 another embodiment of a beverage container 40 will be described. Container 40 is essentially identical to container 10 except that container 40 is a martini glass and has a different shaped vessel 42. As such, container 40 is labeled with the same reference numerals for elements that are the same as those used with container 10.

When stem 30 is screwed into cavity 20, vessel 42 has a conical shape that is continuous at the interface between vessel 42 and stem 30.

Figure 4A:
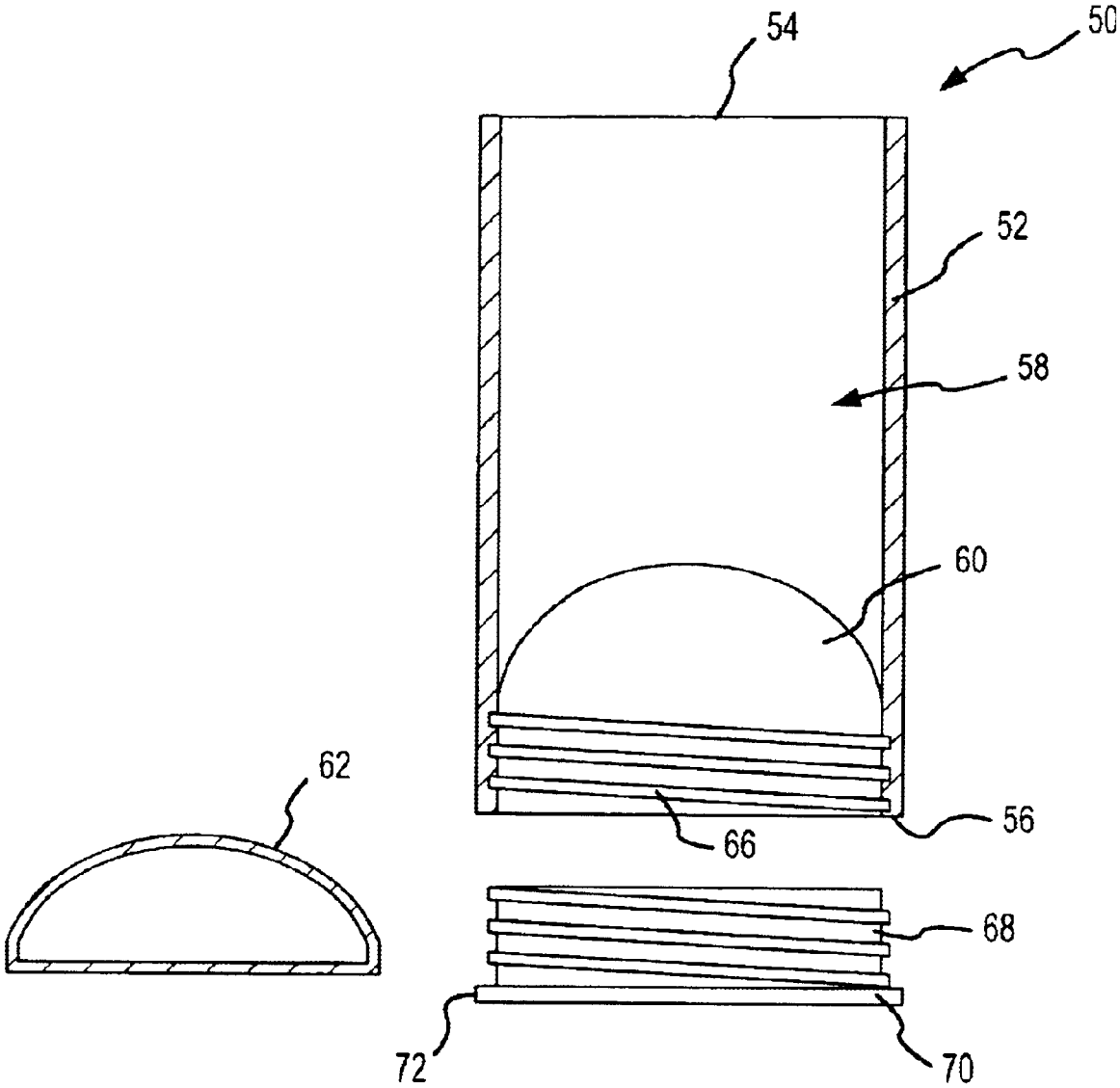
FIG. 4A is an exploded cross sectional side view of the container of FIG. 4.
Figure 4:
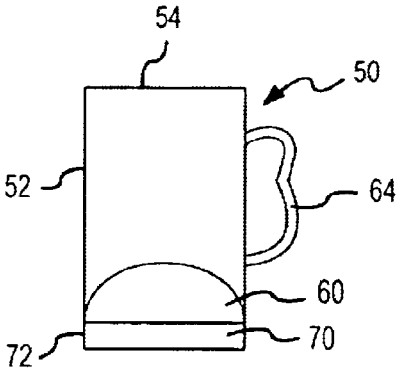
FIG. 4 is a side view of another embodiment of a container according to the invention.

FIGS. 4 and 4A illustrate a beverage container 50 in the shape of a mug. Container 50 comprises a vessel 52 having an open top 54 and a closed bottom 56 to form an interior 58. Extending up onto the interior 58 is a hemispherical cavity 60 to hold a hemispherical cooling element 62. This shape maximizes the coolable surface wherein interior 58 to maximize cooling. Conveniently, a handle 64 may be coupled to vessel 52.

Bottom 56 includes internal threads 66 to mate with threads 68 on a base 70 having an outer edge 72. After cooling element 62 is placed into interior 58, base 70 is screwed into bottom 56 until edge 72 is flush with vessel 52 as shown in FIG. 4. Hence, container 50 has the shape of a traditional mug while also containing a cooling element that is configured to maximize heat transfer. In addition, container 50 includes all of the benefits of the other containers described herein.

Figure 11:
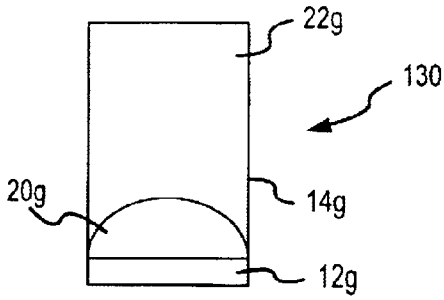
FIG. 11 is a side view of still a further embodiment of a beverage container according to the invention.
Figure 5:
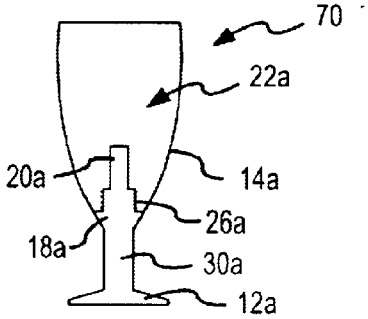
FIG. 5 is a side view of still another embodiment of a beverage container according to the invention.
Figure 6:
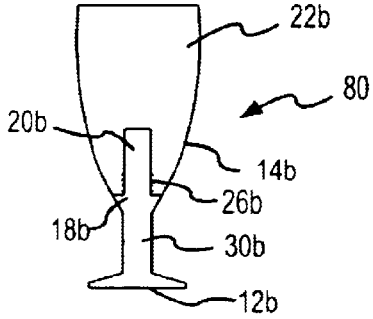
FIG. 6 is a side view of yet another embodiment of a beverage container according to the invention.
Figure 7:
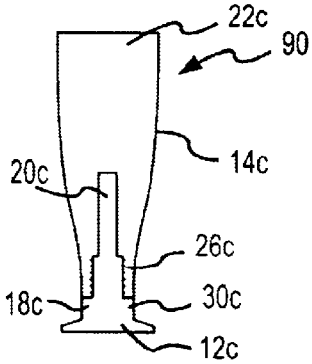
FIG. 7 is a side view of one particular embodiment of a beverage container according to the invention.
Figure 8:
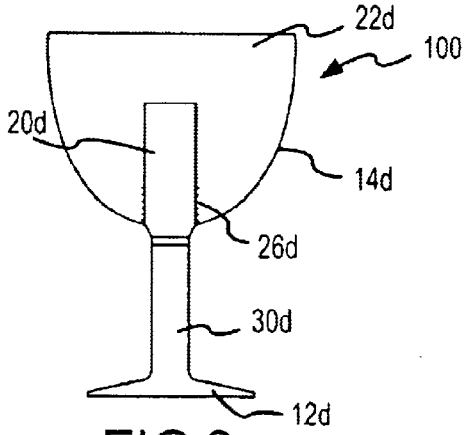
FIG. 8 is a side view of another embodiment of a beverage container according to the invention.
Figure 9:
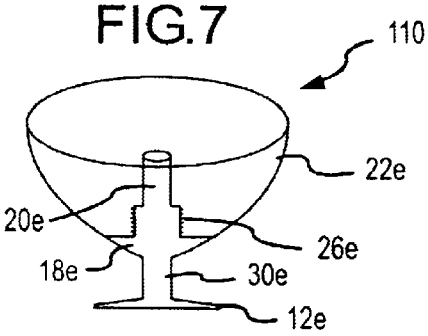
FIG. 9 is a side view of a further embodiment of a beverage container according to the invention.
Figure 10:
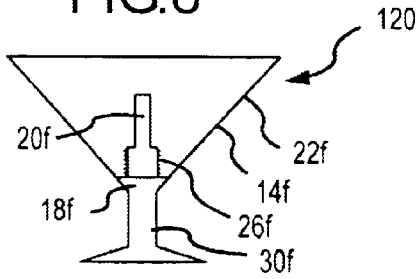
FIG. 10 is a side view of yet a further embodiment of a beverage container according to the invention.

FIGS. 5–10 describe various other embodiments of beverage containers that are constructed in a manner similar to the other containers described herein. As such, the containers in FIGS. 5–10 are labeled with similar elements followed by "a" through "g". FIG. 5 illustrates a white wine glass 70, and FIG. 6 illustrates a champagne glass 80. FIG. 7 illustrates a Stein glass 90, and FIG. 8 illustrates another wine glass 100. FIG. 9 illustrates a margarita glass 110, and FIG. 10 illustrates another martini glass 120. FIG. 11 illustrates a tumbler 130 that is similar to mug 50 of FIG. 4 without a handle. Other types of glasses include red wine glasses, brandy snifter glasses, along with essentially any other type of glass or beverage container.

Figure 12:
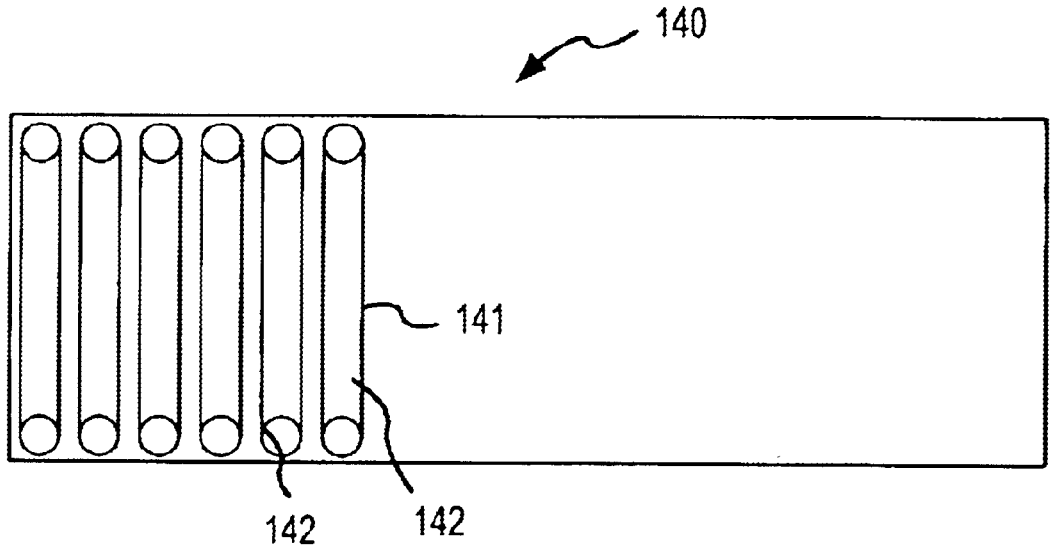
FIG. 12 is a top view of one embodiment of a tray for holding cooling elements according to the invention.

FIG. 12 illustrates one embodiment of a tray 140 having a plurality of recessed regions 141 that may be semi-cylindrical in geometry for holding a set of cylindrical cooling elements 142. In this way, multiple cooling elements 142 may simultaneously be placed into a freezer while using minimal space. When a beverage container needs a new cooling element, it may simply be removed from tray 140 and placed into the cavity as previously described. The old cooling element may then be placed onto tray 140 which is placed into the freezer. Further, it will be appreciated that tray 140 may have any shape of indentation needed to match the shape of the cooling element, including any of the shapes described herein.

Figure 13:
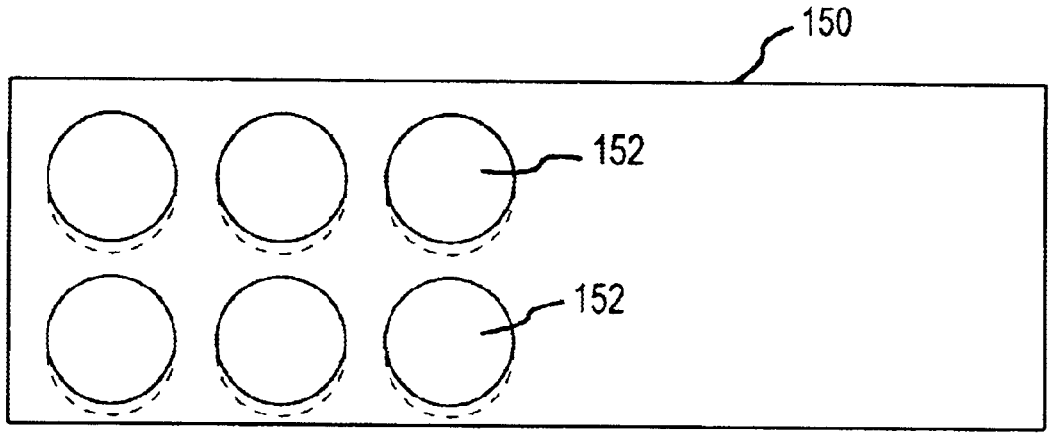
FIG. 13 is a top view of another embodiment of a tray for holding cooling elements according to the invention.

FIG. 13 illustrates an alternative tray 150 having a plurality of hemispherical recesses 152 for receiving hemispherical cooling elements. Tray 150 may be used in a manner similar to tray 140.

The invention has now been described in detail for purposes of clarity and understanding. However, it will be appreciated that certain changes and modifications may be practiced within the scope of the appended claims.

What is claimed is:

1. A beverage container, comprising:

a vessel having an interior that is adapted to hold a beverage, wherein the vessel has a closed bottom end and an open top end, and wherein the bottom end defines a cavity that is fluidly sealed from the interior of the vessel;

a cooling element that is configured to fit within the cavity;

a base comprising a bottom member and a stem extending vertically upward from the bottom member, wherein the base includes a connector that is configured to be operably coupled to the bottom end of the vessel and to enclose the cooling element within the cavity.

2. A container as in claim 1, wherein the connector comprises a threaded end on the stem, wherein the cavity includes a threaded section, and wherein the threaded end is configured to be screwed up into the cavity using the threaded section.

3. A beverage container as in claim 2, wherein the connector and the vessel are constructed of a material selected from a group consisting of glass, hard plastic, and glass coated with hard plastic.

4. A container as in claim 1, wherein the cavity is generally cylindrical in geometry and extends vertically upward into the interior of the vessel, and wherein the cooling element comprises a cylinder that is filled with a cooling substance.

5. A container as in claim 1, wherein the vessel has a shape selected from a group consisting of a mug, a regular wine glass, a red wine glass, a white wine glass, a martini glass, a tumbler, a stein glass, a margarita glass, a brandy snifter and a champagne glass.

* * * * *